US009962724B2

(12) United States Patent
Fujiwara et al.

(10) Patent No.: US 9,962,724 B2
(45) Date of Patent: May 8, 2018

(54) TRIGGER-TYPE FLUID JETTING DEVICE

(71) Applicants: Kotaro Fujiwara, Tokyo (JP); Hiroyuki Nakamura, Tokyo (JP); Shigeo Iizuka, Tokyo (JP)

(72) Inventors: Kotaro Fujiwara, Tokyo (JP); Hiroyuki Nakamura, Tokyo (JP); Shigeo Iizuka, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 0 days. days.

(21) Appl. No.: 15/121,300

(22) PCT Filed: Feb. 25, 2015

(86) PCT No.: PCT/JP2015/000959
§ 371 (c)(1),
(2) Date: Aug. 24, 2016

(87) PCT Pub. No.: WO2015/129268
PCT Pub. Date: Sep. 3, 2015

(65) Prior Publication Data

US 2017/0014844 A1 Jan. 19, 2017

(30) Foreign Application Priority Data

Feb. 28, 2014 (JP) ..... 2014-039964

(51) Int. Cl.
*B05B 11/00* (2006.01)
*B05B 7/00* (2006.01)
(Continued)

(52) U.S. Cl.
CPC ..... *B05B 11/3098* (2013.01); *B05B 7/005* (2013.01); *B05B 11/0016* (2013.01);
(Continued)

(58) Field of Classification Search
CPC ..... B05B 11/0016; B05B 11/0059; B05B 11/3002; B05B 11/3069; B05B 11/0008;
(Continued)

(56) References Cited

U.S. PATENT DOCUMENTS 5,755,384 A * 5/1998 Foster ..... B05B 1/02 222/383.1
6,869,027 B2 * 3/2005 Foster ..... B05B 11/3009 222/383.1
6,997,397 B1 * 2/2006 Keung ..... B05B 1/1654 222/553

FOREIGN PATENT DOCUMENTS

JP H04-363162 A 12/1992
JP H11-290731 A 10/1999
(Continued)

OTHER PUBLICATIONS

Sep. 6, 2016 International Preliminary Report on Patentability issued in International Patent Application No. PCT/JP2015/000959.
(Continued)

*Primary Examiner* — Frederick C Nicolas
(74) *Attorney, Agent, or Firm* — Oliff PLC

(57) ABSTRACT

A dispenser main body (11) includes a cylindrical-shaped fitted portion (16*a*), and a nozzle (40) includes: a nozzle main body (41) and a nozzle extension body (42). The nozzle (40) is provided with a dispensing tube (51) including: a first dispensing tubular portion (51*a*) and a cylindrical-shaped second dispensing tubular portion (51*b*). A cut-out (52*a*) is provided in the front end of the first dispensing tubular portion (51*a*) or in a base end of the second dispensing tubular portion (51*b*), and an opening end of the cut-out (52*a*) is closed by the first dispensing tubular portion (51*a*) or the second dispensing tubular portion (51*b*) to provide an air inlet hole (52) in the dispensing tube (51).

2 Claims, 11 Drawing Sheets

(51) Int. Cl.
*B05B 1/12* (2006.01)
*B05B 7/04* (2006.01)

(52) U.S. Cl.
CPC ..... *B05B 11/0059* (2013.01); *B05B 11/3002* (2013.01); *B05B 11/3011* (2013.01); *B05B 11/3069* (2013.01); *B05B 1/12* (2013.01); *B05B 7/0425* (2013.01); *B05B 11/007* (2013.01); *B05B 11/0008* (2013.01); *B05B 11/0032* (2013.01); *B05B 11/3077* (2013.01)

(58) Field of Classification Search
CPC ..... B05B 11/3077; B05B 11/007; B05B 11/0032; B05B 7/0425; B05B 7/005; B05B 1/12; B05B 11/3011
See application file for complete search history.

(56) References Cited

FOREIGN PATENT DOCUMENTS

| | | | |
|---|---|---|---|
| JP | 2002-096857 | A | 4/2002 |
| JP | 2004-105902 | A | 4/2004 |
| JP | 2011-251221 | A | 12/2011 |

OTHER PUBLICATIONS

May 19, 2015 International Search Report issued in International Patent Application No. PCT/JP2015/000959.

Apr. 1, 2017 Office Action issued in Chinese Patent Application No. 201580010361.7.

Nov. 30, 2017 Office Action issued in Korean Patent Application No. 10-2016-7023795.

Sep. 1, 2017 Office Action issued in Chinese Patent Application No. 201580010361.7.

Sep. 12, 2017 Office Action issued in Japanese Patent Application No. 2014-039964.

Sep. 18, 2017 extended European Search Report issued in European Patent Application No. 15754873.6.

Oct. 13, 2017 Office Action issued in Canadian Application No. 2,941,007.

* cited by examiner

A-A section

TRIGGER-TYPE FLUID JETTING DEVICE

TECHNICAL FIELD

The present disclosure relates to a trigger-type fluid jetting device (hereinafter, called the trigger-type liquid dispenser) liquid dispenser that is attached to a mouth of a container containing a liquid and that dispenses the liquid contained in the container through a nozzle.

BACKGROUND

As a dispenser attached to a mouth of a container containing a liquid, such as a an antimold, a detergent, a sizing agent for textiles, household wax, a hair liquid, an aromatic, a repellent, a pesticide, and a medicine, there is known a trigger-type liquid dispenser that, in response to operation of a trigger, actuates a pump to dispense such a liquid in the form of foam through a nozzle.

Such a trigger-type liquid dispenser includes a dispenser main body fitted to the mouth of the container by, for example, a fitting cap, and the dispenser main body is fitted with a pump and is also provided with a delivery flow path of the liquid force-fed to the pump, and the nozzle is fitted to a delivery port, which is an outlet end of the delivery flow path. The nozzle is structured to include a tubular-shaped outer tubular body that, in a section thereof, has a triangular or a rectangular shape and is also structured to include a partition wall that is disposed on the inner side of the outer tubular body and that has a dispensing hole. Thus, the liquid, after being force-fed to the delivery port through the delivery flow path by the pump, is dispensed to the outside through the dispensing hole. Furthermore, the nozzle is provided with an air inlet hole that extends in a direction perpendicular to the axis direction of the dispensing hole and that has one end open to an outer surface of the outer tubular body and another end open in adjacent to the dispensing hole, and air drawn through the air inlet hole is mixed to the liquid dispensed through the dispensing hole to allow the dispensed liquid to foam (refer to, for example, Patent Literature 1).

CITATION LIST

Patent Literature

PTL1: JPH11290731A

SUMMARY

Technical Problems

However, the conventional trigger-type liquid dispenser poses problems that mold structure used in molding is complicated and that molding of the nozzle is difficult, because, at the time of resin molding the nozzle with use of molds, the air inlet hole is formed on a side surface of the dispensing tube by lateral cut-out using, for example, a slide pin that is displaceable in a direction perpendicular to a direction in which the molds are assembled.

The present disclosure is to solve the above problems, and the present disclosure is to provide a trigger-type liquid dispenser including the nozzle, including the dispensing tube provided with the air inlet hole, that may be molded easily with use of simple-structure molds.

Solution to Problems

One of aspects of the present disclosure resides in a trigger-type liquid dispenser including: a dispenser main body fitted to a mouth of a container containing a liquid; a pump configured to be actuated, in response to operation of a trigger, to force-feed the liquid contained in the container to a delivery port through a delivery flow path provided in the dispenser main body; and a nozzle fitted to the dispenser main body to dispense, to outside, the liquid force-fed to the delivery port. The dispenser main body includes a cylindrical-shaped fitted portion communicating with the delivery port. The nozzle includes: a nozzle main body in which a tubular-shaped outer tubular body, which covers an outer circumference of the fitted portion, and a partition wall, which is disposed on an inner side of the outer tubular portion to cover an opening end of the fitted portion and which is provided with a dispensing hole, are integrally provided; and a nozzle extension body that includes a tubular-shaped outer tube extension body coupled to a front end of the outer tubular body and that is fitted to the nozzle main body from a direction extending along a central axis of the nozzle main body. The nozzle is provided with a dispensing tube including: a first dispensing tubular portion that is formed in a cylindrical shape having a central axis aligned with a central axis of the dispensing hole and that is provided integrally on a surface of the partition wall that faces to the outside; and a cylindrical-shaped second dispensing tubular portion that is provided integrally with the outer tube extension body on an inner side of the outer tube extension body and that is disposed on a front end of the first dispensing tubular portion in an overlapped manner. A cut-out is provided in the front end of the first dispensing tubular portion or in a base end of the second dispensing tubular portion, and an opening end of the cut-out is closed by the first or the second dispensing tubular portion to provide an air inlet hole in the dispensing tube.

Another aspect of the present disclosure resides in a trigger-type liquid dispenser including: a dispenser main body fitted to a mouth of a container containing a liquid; a pump configured to be actuated, in response to operation of a trigger, to force-feed the liquid contained in the container to a delivery port through a delivery flow path provided in the dispenser main body; and a nozzle fitted to the dispenser main body to dispense, to outside, the liquid force-fed to the delivery port. The dispenser main body includes a cylindrical-shaped fitted portion communicating with the delivery port. The nozzle includes: a nozzle main body in which a tubular-shaped outer tubular body, which covers an outer circumference of the fitted portion, and a partition wall, which is disposed on an inner side of the outer tubular portion to cover an opening end of the fitted portion and which is provided with a dispensing hole, are integrally provided; and a nozzle extension body that includes a tubular-shaped outer tube extension body coupled to a front end of the outer tubular body and that is fitted to the nozzle main body from a direction extending along a central axis of the nozzle main body. The nozzle further includes a dispensing tube that is formed in a cylindrical shape having a central axis aligned with a central axis of the dispensing hole, that is provided integrally with the outer tube extension body on an inner side of the outer tube extension body, and that has a base end abutting against a surface of the partition wall that faces to the outside. A cut-out is provided in the base end of the dispensing tube, and an opening end of the cut-out is closed by the partition wall to provide an air inlet hole in the dispensing tube.

In a preferred embodiment of the trigger-type liquid dispenser with the above structure, the outer tube extension body is provided, on a front end thereof and via a hinge portion, integrally with a cap body including a foam generation hole facing to the dispensing tube, and the cap body is provided with a vent hole that, when the front end of the outer tube extension body is closed by the cap body, draws air to inner side space of the outer tube extension body that is located between the partition wall and the cap body.

Advantageous Effects

The present disclosure allows formation of the nozzle including the dispensing tube provided with the air inlet holes by combining the nozzle main body and the nozzle extension body that may be molded with use of simple-structure molds, without using complex-structure molds including, for example, a slide pin that is displaceable in a direction perpendicular to a direction in which the molds are assembled. Accordingly, simple-structure molds may be used as molds required for molding the nozzle, and manufacturing cost of the trigger-type liquid dispenser is reduced.

DETAILED DESCRIPTION

The present disclosure will be described by illustration in more detail below with reference to the drawings.

Figure 1:
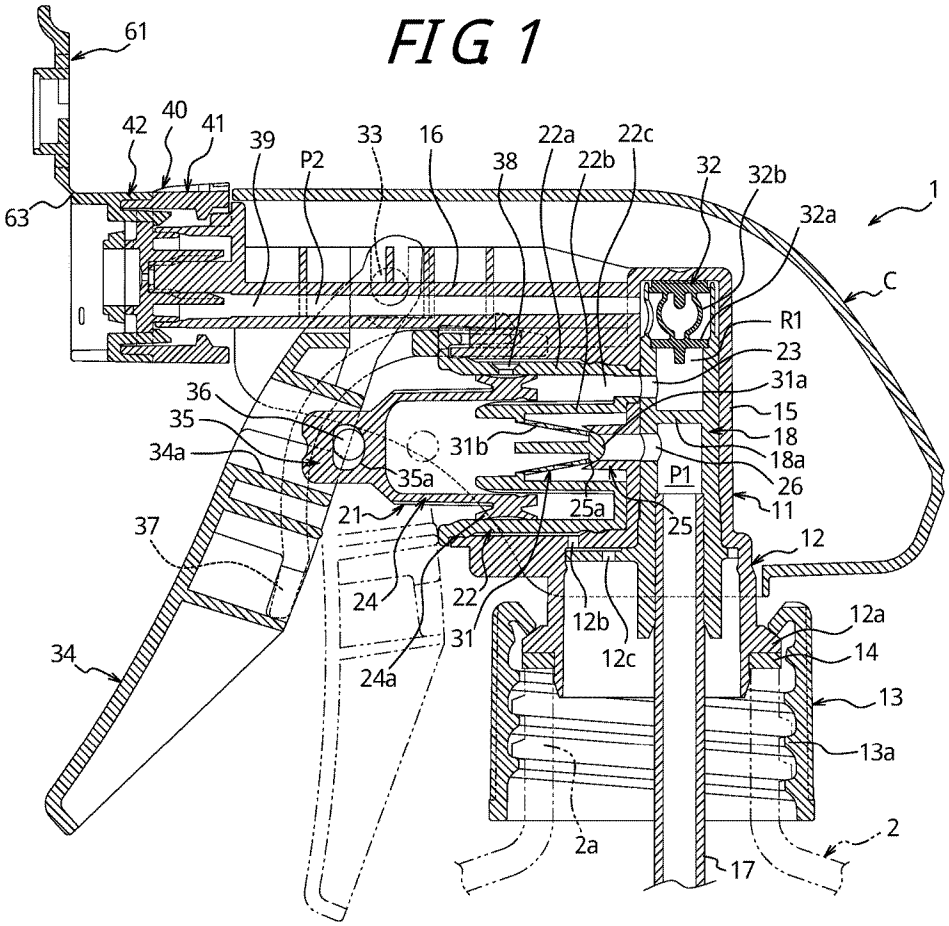
FIG. 1 is a sectional view of a trigger-type liquid dispenser according to the first embodiment of the present disclosure.

A trigger-type liquid dispenser 1 according to the first embodiment of the present disclosure illustrated in FIG. 1 may be, during use, attached to a mouth 2*a* of a container 2 containing a liquid, such as a an antimold, a detergent, a sizing agent for textiles, household wax, a hair liquid, an aromatic, a repellent, a pesticide, and a medicine. The trigger-type liquid dispenser 1 includes a resin-made dispenser main body 11 attached to the mouth 2*a* of the container 2.

The dispenser main body 11 includes a fitted tubular portion 12 having a cylindrical shape corresponding to the mouth 2*a* of the container 2, and the fitted tubular portion 12 is provided on an outer circumferential surface thereof with a flange portion 12*a* to which a fitting cap 13 is locked to be fitted. The fitting cap 13 is provided on an inner circumferential surface thereof with a female screw 13*a*, and, by the fitting cap 13 being screw-connected to a male screw provided in the mouth 2*a* of the container 2, the dispenser main body 11, that is to say, the trigger-type liquid dispenser 1 may be fitted to the mouth 2*a* of the container 2. Additionally, reference numeral 14 denotes a sealing member disposed for sealing between the mouth 2*a* of the container 2 and the flange portion 12*a*.

The dispenser main body 11 is formed to have a substantially L-shaped appearance including a standing portion 15 extending from the fitted tubular portion 12 in a direction extending along the central axis of the fitted tubular portion 12 and also including an extension portion 16 extending in a direction orthogonal to the standing portion 15. The standing portion 15 is provided inside thereof with an intake flow path P1 communicating with the fitted tubular portion 12, and the intake flow path P1 has a lower end to which a suction tube 17, which is inserted into the container 2, is connected. On the other hand, the extension portion 16 is provided with a delivery flow path P2 extending in a direction orthogonal to the intake flow path P1, and a check valve chamber R1 is defined between the intake flow path P1 and the delivery flow path P2. The intake flow path P1 and the check valve chamber R1 are formed by a tubular body 18, inside of which is divided into two portions in a direction extending along the central axis of the standing portion 15, being included in the standing portion 15.

To the dispenser main body 11, a pump 21 is fitted. The pump 21 includes a cylinder member 22 that is embedded and fixed between the fitted tubular portion 12 of the dispenser main body 11 and the extension portion 16. The cylinder member 22 includes a cylinder tubular portion 22*a*, a partition tubular portion 22*b*, and an annular ring-shaped partition chamber 22*c* defined between the cylinder tubular portion 22*a* and the partition tubular portion 22*b*. The partition chamber 22*c* communicates with the check valve chamber R1 via a delivery hole 23 provided in the tubular body 18. To the cylinder tubular portion 22*a*, a cylindrical-shaped piston 24, which has one end that is closed, is fitted displaceably in a direction extending along the central axis of the cylinder tubular portion 22*a*. The piston 24 is integrally provided, on an outer circumferential side of a tip portion of the cylindrical shape thereof, with a sealing portion 24*a* that is in sliding contact with an inner circumferential surface of the cylinder tubular portion 22*a*.

The standing portion 15 of the dispenser main body 11 is provided integrally with a cylindrical-shaped intake tubular portion 25. The intake tubular portion 25 is disposed on the inner side of the partition tubular portion 22*b*, with the central axis of the intake tubular portion 25 being aligned with the central axis of the partition tubular portion 22*b*. One end side of the intake tubular portion 25 communicates with the intake flow path P1 via an intake hole 26 provided in the tubular body 18. The intake tubular portion 25 has a front end surface 25*a* exposed to the inside of the pump 21, and the front end surface 25*a* is formed as a tapered (conical) surface that becomes more concave toward the intake hole 26 as the surface is closer to the inner side in the radial direction. On the front end surface 25*a*, an intake-side check valve 31 is disposed.

The intake-side check valve 31 includes a valve main body 31*a* having a hemispherical shape with a diameter that permits a spherical surface of the valve main body 31*a* to abut against the front end surface 25*a* of the intake tubular portion 25. The valve main body 31*a* is coupled integrally to the inner circumferential surface of the cylinder tubular portion 22*a* via a helical-shaped elastic portion 31*b*, and the valve main body 31*a* is also urged toward the front end surface 25*a* by the elastic portion 31*b*. Thus, the valve main body 31*a* is pressed to abut against the front end surface 25*a* of the intake tubular portion 25 that serves as a valve seat of the spherical surface of the valve main body 31*a*. The elastic portion 31*b* has a shape whose diameter is gradually decreased from the partition tubular portion 22*b* toward the valve main body 31*a*, and the elastic portion 31*b* may undergo elastic deformation to a direction in which the valve main body 31*a* is away from the front end surface 25*a*. With the above structure, the intake-side check valve 31 allows the liquid to be drawn into the pump 21 through the intake hole 26 from the intake flow path P1 and also prevents the liquid from flowing from the inside of the pump 21 back into the intake flow path P1 through the intake hole 26.

On the other hand, the check valve chamber R1 is provided with a delivery-side check valve 32. The delivery-side check valve 32 includes a plate-shaped valve main body 32*a*, which is urged toward the pump 21 by the curved elastic portion 32*b* to abut against a step provided on an inner circumferential surface of the tubular body 18. With the above structure, the delivery-side check valve 32 allows the liquid to be delivered from the pump 21 to the delivery flow path P2 through the delivery hole 23 and also prevents the liquid from flowing from the delivery flow path P2 back into the pump 21 through the delivery hole 23.

The dispenser main body 11 is provided with a trigger 34 (an operating lever) that is supported rotatably by a pivot shaft 33. The piston 24 is provided integrally with a coupling piece 35, which is coupled to the trigger 34 rotatably by a pin member 36 provided in the trigger 34 engaging with a concave portion 35*a* provided in the coupling piece 35 in the state where the coupling piece 35 is inserted to a orifice portion 34*a* provided in a middle portion of the trigger 34. Furthermore, the trigger 34 is urged toward a direction (a clockwise direction centered about the pivot shaft in the figure) away from the pump 21 by a curve-shaped plate spring 37 having one end fixed to and held by the dispenser main body 11 and also having a front end locked to the trigger 34. Additionally, the dispenser main body 11 and the pump 21 are covered by a cover C, and the trigger 34 protrudes from a lower side of the cover C.

Once the trigger 34 is operated manually and pulled to a stroke limit position represented by a two-dot chain line in FIG. 1 toward the pump 21, the intake-side check valve 31 is closed, and the piston 24 is pushed into the partition chamber 22*c*. This increases a liquid pressure in the pump 21 and causes the liquid in the pump 21 to be delivered from the delivery hole 23 to the delivery flow path P2 through the check valve chamber R1. At this time, since a gap is formed between an inner circumferential surface of the piston 24 and an outer circumferential surface of the partition tubular portion 22*b*, a large volume of liquid, including not only the liquid in the partition chamber 22*c* but also the liquid in the piston 24 and inside the partition tubular portion 22*b*, may be delivered toward the delivery flow path P2.

When the operation of the trigger 34 is released, the trigger 34 is returned to an initial position due to resilience force of the plate spring 37. In conjunction with the return movement, the delivery-side check valve 32 is closed, the intake-side check valve 31 is opened, and the liquid contained in the container 2 is sucked from the intake hole 26 into the pump 21 through the tube 17 and the intake flow path P1. Additionally, the cylinder tubular portion 22*a* is provided with an air intake hole 38, which is exposed to the outside when the trigger 34 is operated to the stroke limit. Air drawn through the air intake hole 38 is then drawn into the container 2 through an annular-shaped gap defined between the cylinder tubular portion 22*a* of the pump 21 and the dispenser main body 11 and through vent holes 12*b* and 12*c* provided on an upper surface wall of the fitted tubular portion 12, and accordingly, after the liquid is dispensed, the space in the container 2 is replaced with air.

By thus fitting the trigger-type liquid dispenser 1 according to the present disclosure to the mouth 2*a* of the container 2 and repeating pulling and releasing operations of the trigger 34, the pump 21 may be actuated to force-feed (pump) the liquid contained in the container 2 to a delivery port 39 of the liquid through the delivery flow path P2.

To a front end of the extension portion 16 of the dispenser main body 11, a nozzle 40 is fitted. The nozzle 40 is used to dispense the liquid, after being force-fed from the container 2 to the delivery port 39 by the pump 21, to the outside in the form of foam.

Figure 2:
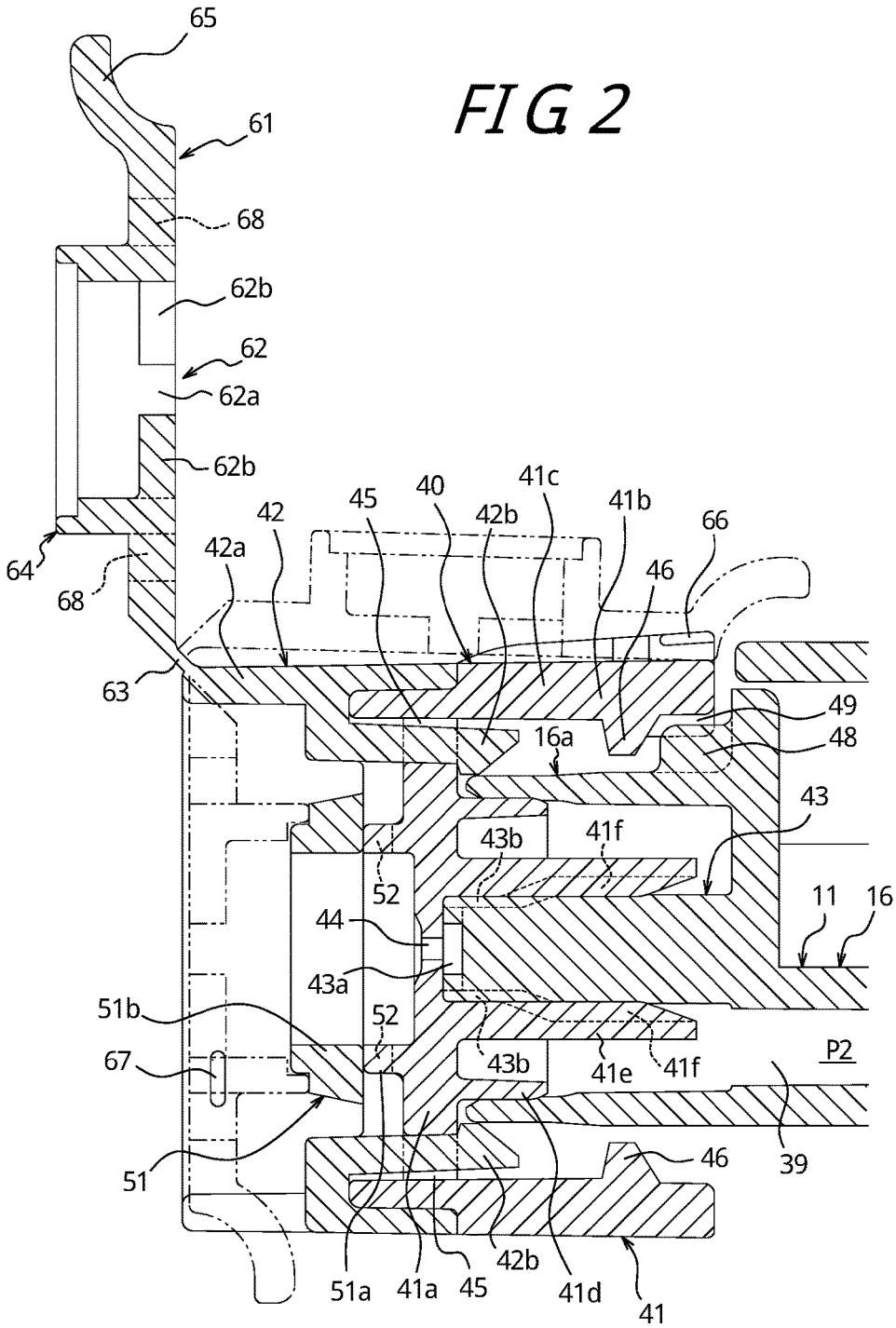
FIG. 2 is an enlarged sectional view of a portion of a trigger-type liquid dispenser illustrated in FIG. 1 to which a nozzle is fitted.

As illustrated in FIG. 2, the front end of the extension portion 16 of the dispenser main body 11 is provided integrally with a fitted portion 16*a* permitting the nozzle 40 to be fitted. The fitted portion 16*a* is formed in a cylindrical shape protruding from the front end of the extension portion 16, and the delivery port 39, which is an outlet end of the delivery flow path P2, is open to a lower side of the inside of the fitted portion 16*a*. That is to say, the fitted portion 16*a*, in the inside thereof, communicates with the delivery port 39 of the delivery flow path P2. Furthermore, the front end of the extension portion 16 is provided integrally with a columnar-shaped switch shaft 43 whose central axis is aligned with the central axis of the fitted portion 16*a*.

The nozzle 40 has a double-block structure combining a nozzle main body 41 and a nozzle extension body 42 in a direction extending along the central axes thereof, and the nozzle main body 41 and the nozzle extension body 42 are each obtained by injection molding a resin material with use of a mold.

The nozzle main body 41 includes a disc-shaped partition wall 41*a* covering an opening end of the fitted portion 16*a* and an outer circumferential wall 41*b* formed in a cylindrical shape contiguous with an outer circumference of the partition wall 41*a* to cover the periphery of the fitted portion 16*a*. Furthermore, as can be seen from FIGS. 3A and 3B, the contour of the nozzle main body 41 is formed by an outer tubular body 41*c* that includes four outer walls and that has a substantially square tubular-shape as viewed in a direction extending along the central axis of the nozzle main body 41, i.e., from the front side. The partition wall 41*a* and the outer circumferential wall 41*b* are formed integrally on the inner side of the outer tubular body 41*c*.

The partition wall 41*a* of the nozzle main body 41 is provided with a dispensing hole 44 extending through the partition wall 41*a* along the central axis of the outer circumferential wall 41*b*. The dispensing hole 44 is a small hole with a sectional area that is sufficiently smaller than a sectional area of the delivery port 39. The partition wall 41*a* is further provided, on an inner side surface thereof that faces to the fitted portion 16*a*, integrally with a cylindrical-shaped closing tubular portion 41*d* disposed coaxially with the dispensing hole 44. With the closing tubular portion 41*d* being fitted on the inner side of the fitted portion 16*a*, the partition wall 41*a* closes the opening end of the fitted portion 16*a*. Furthermore, the partition wall 41*a* is provided, on the inner side surface thereof, integrally with a switch tubular portion 41*e* disposed coaxially with the closing tubular portion 41*d* on the inner side of the closing tubular portion 41*d*. The switch tubular portion 41*e* is fitted on the outer side of the switch shaft portion 43. The closing tubular portion 41*d* and the switch tubular portion 41*e* are rotatable relatively with respect to the fitted portion 16*a* and the switch shaft portion 43, respectively. That is to say, the nozzle main body 41 is rotatable with respect to the fitted portion 16*a* about the axis of the partition wall 41*a*.

Figure 3A:
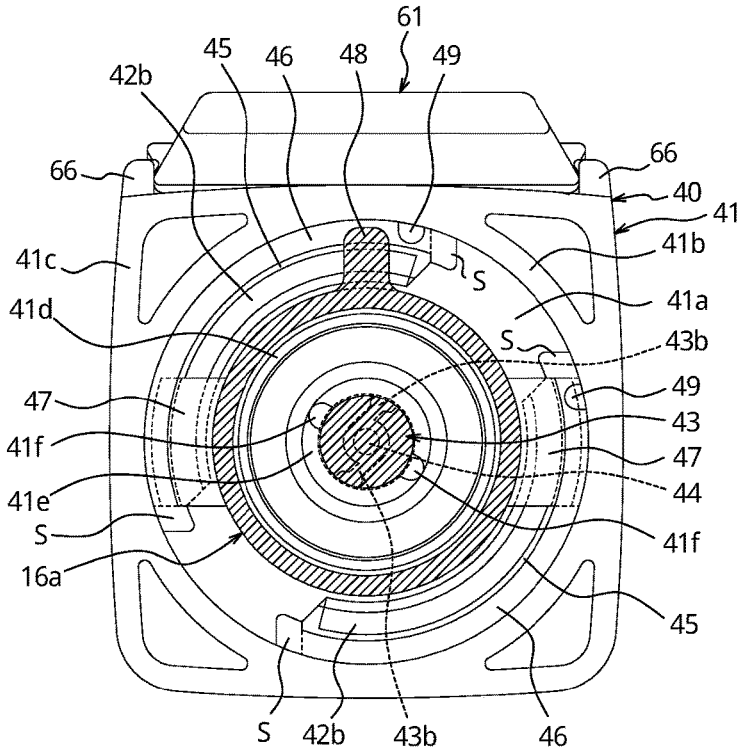
FIG. 3A is a sectional view of a nozzle in a closed position as viewed from the back, and FIG. 3 B is a sectional view of a nozzle in an opened position as viewed from the back.
Figure 3B:
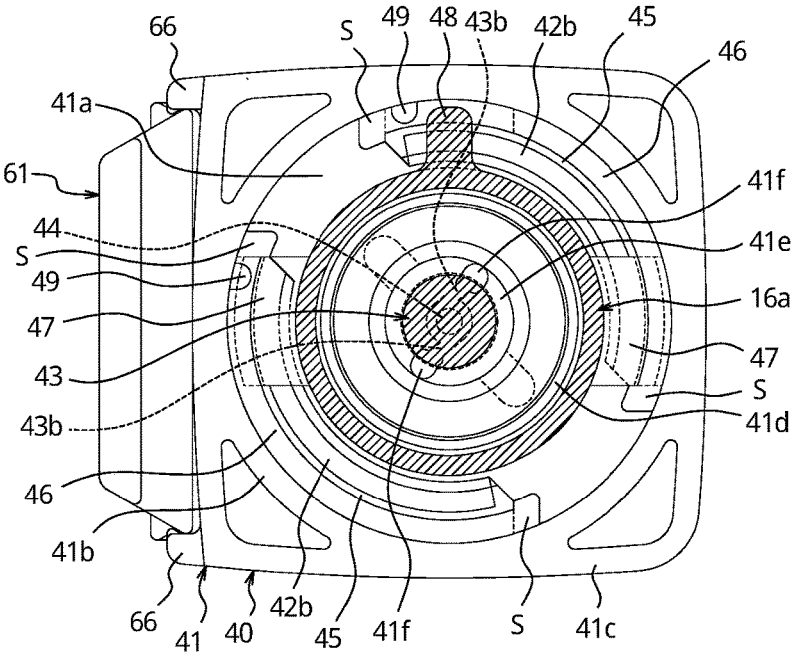

The switch shaft portion 43 is provided, on a front end surface thereof, with a concave portion 43*a* that is circularly concave, and the switch shaft portion 43 is also provided, in a predetermined range of an outer circumferential surface that is located on the front end side thereof, with a pair of connecting flow paths 43*b* that communicates with the concave portion 43*a*, that extends in a direction extending along the central axis of the switch shaft portion 43, and that is disposed symmetrically about the central axis of the switch shaft portion 43. On the other hand, the switch tubular portion 41*e* is provided, on an inner circumferential surface, with a pair of connecting flow paths 41*f* that extends from a tip of the switch tubular portion 41*e* to a position overlapping with the connecting flow paths 43*b* provided in the switch shaft portion 43 in a direction extending along the central axis of the switch shaft portion 43 and that is disposed symmetrically about the central axis of the switch tubular portion 41*e*. As illustrated in FIG. 3A, when the nozzle main body 41 (the nozzle 40) is in a closed position, the connecting flow paths 43*b* of the switch shaft portion 43 and the connecting flow paths 41*f* of the switch tubular portion 41*e* are offset in the rotational direction to be out of communication, and thus, the nozzle main body 41 (the nozzle 40), with the dispensing hole 44 being blocked with respect to the delivery port 39, is in the closed state where the liquid cannot be dispensed. On the other hand, as illustrated in FIG. 3B, when the nozzle main body 41 (the nozzle 40) is in an opened position, which is rotated 90 degrees from the closed position with respect to the fitted portion 16*a*, the connecting flow paths 43*b* of the switch shaft portion 43 and the connecting flow paths 41*f* of the switch tubular portion 41*e* are in communication, and thus, the nozzle main body 41 (the nozzle 40), with the dispensing hole 44 communicating with the delivery port 39, is in the opened state where the liquid may be dispensed. Then, rotating the nozzle main body 41 (the nozzle 40) 90 degrees brings the nozzle main body 41 (the nozzle 40) into the closed position again. By thus rotating the nozzle main body 41 (the nozzle 40) between the closed and the opened position, opening and closing of the dispensing hole 44 may be switched.

As illustrated in FIGS. 2, 3A, and 3B, the partition wall 41*a* of the nozzle main body 41 is provided with a pair of through holes 45 extending along a portion of the partition wall 41*a* that is joined to the outer circumferential wall 41*b*. These through holes 45 each extend in a range of approximately 90 degrees about the central axis of the outer circumferential wall 41*b* and are formed as a pair of arc-shaped holes disposed in point symmetry about the central axis of the outer circumferential wall 41*b*.

Furthermore, the outer circumferential wall 41*b* of the nozzle main body 41 is provided, on one side of an inner circumferential surface thereof that is located closer to the tip thereof than to the partition wall 41*a*, with a pair of locking protrusions 46 protruding toward the inner side in the radial direction. As illustrated in FIGS. 3A and 3B, these locking protrusions 46 are each formed in an arc shape extending circumferentially along the inner circumferential surface of the outer circumferential wall 41*b* in the same range as the range of the corresponding through hole 45 so that the locking protrusion 46 is located in the range overlapping with the corresponding through hole 45 as viewed from a direction extending along the central axis of the outer circumferential wall 41*b*.

On the other hand, as illustrated in FIGS. 3A and 3B, the fitted portion 16*a* is provided, on an outer circumferential surface thereof, integrally with a pair of protruding portions 47 in correspondence with the aforementioned locking protrusions 46. These protruding portions 47 are each formed in a plate shape protruding to the outer side in the radial direction from the outer circumferential surface of the fitted portion 16*a* and has a width in the circumferential direction that is approximately ¼ of the width of the corresponding locking protrusion 46.

In a state where the nozzle main body 41 is fitted to the fitted portion 16*a*, the locking protrusions 46 are in undercut engagement with the protruding portions 47 of the fitted portion 16*a*, and accordingly, the nozzle main body 41 (the nozzle 40) is locked in a direction extending along the central axis thereof and is prevented from being detached from the fitting portion 16*a* by the protruding portions 47 while being fitted rotatably with respect to the fitted portion 16*a*. Since the pair of locking protrusions 46 are disposed in point symmetry in the range of approximately 90 degrees each, as illustrated in FIGS. 3A and 3B, even when the nozzle main body 41 (the nozzle 40) is rotated between the closed and the opened position, the locking protrusions 46 are always locked to the protruding portions 47, and therefore, the nozzle main body 41 (the nozzle 40) is prevented from being detached from the fitted portion 16*a*.

Additionally, reference numeral 48 denotes a protrusion provided on the outer circumferential surface of the fitted portion 16*a*, and the projection 48, which climbs over a protrusion 49 provided on the inner circumferential surface of the outer circumferential wall 41*b*, provides a click sensation when the nozzle main body 41 (the nozzle 40) is rotated to the opened or the closed position. Furthermore, each locking protrusion 46 is provided, on both sides thereof, with stoppers S, and each of these stoppers S, against which the corresponding protruding portion 47 abuts, regulates the rotational angle of the nozzle main body 41 (the nozzle 40) to be 90 degrees. By rotating the nozzle main body 41 (the nozzle 40) in the range of 90 degrees, the dispensing hole 44 may be switched from the closed to the opened state, or from the opened to the closed state.

The nozzle main body 41 is not necessarily configured to be prevented from slipping off the fitted portion 16*a* by bringing the locking protrusions 46, provided in the partition wall 41*a*, into undercut engagement with the protruding portions 47 of the fitted portion 16*a*, and other slip-off preventing structures may also be adopted.

The nozzle extension body 42 includes an outer tube extension body 42*a*. Similarly to the outer tubular body 41*c* of the nozzle main body 41, the outer tube extension body 42*a* includes four outer walls and has a substantially square tubular-shape as viewed in the direction extending along the central axis of the nozzle main body 41, i.e., from the front side. The outer tube extension body 42*a* is coupled to a front end of the outer tubular body 41*c* by being fitted on the outer side of a fitting step portion provided on the front end of the outer tubular body 41*c* of the nozzle main body 41. Thus, the contour of the nozzle 40 as a whole is defined by the outer tubular body 41*c* of the nozzle main body 41 and the outer tube extension body 42*a* of the nozzle extension body 42 coupled to the front end of the outer tubular body 41*c*.

On the inner side of the outer tube extension body 42*a*, a pair of arc-shaped locking claws 42*b* is integrally disposed in correspondence with the through holes 45 provided in the nozzle main body 41. These locking claws 42*b* are inserted through the through holes 45 provided in the nozzle main body 41 to be in undercut engagement with a back surface of the partition wall 41*a*, by the nozzle extension body 42 being assembled from the front surface side of the nozzle main body 41 in a direction extending along the central axis thereof. Thus, with the locking claws 42*b* in undercut engagement with the partition wall 41*a*, the nozzle extension body 42 is fitted to the nozzle main body 41.

Figure 4A:
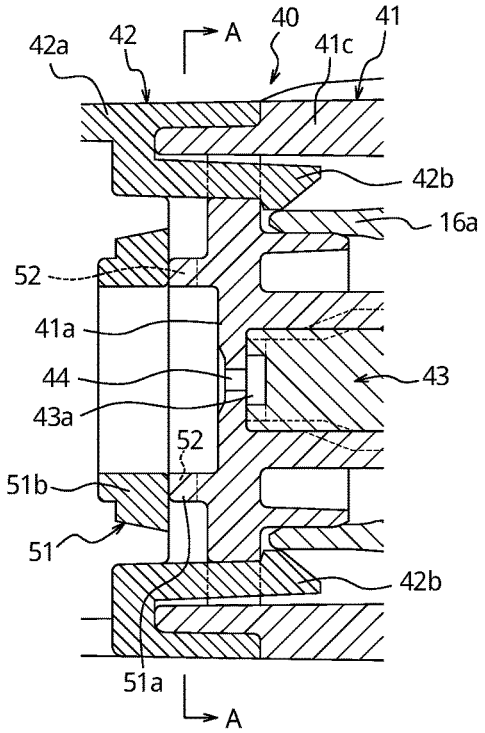
FIG. 4A is a partially enlarged sectional view of a dispensing tube illustrated in FIG. 2.

The nozzle 40 is provided with a dispensing tube 51 surrounding an opening end of the dispensing hole 44 that is located on the outlet side. As illustrated in FIG. 4A, the dispensing tube 51 includes the cylindrical-shaped first dispensing tubular portion 51*a* that is formed integrally on a surface of the partition wall 41*a* that faces to the outside and that has the central axis aligned with that of the dispensing hole 44, and the dispensing tube 51 also includes the cylindrical-shaped second dispensing tubular portion 51*b* that is formed integrally with the outer tube extension body 42*a* of the nozzle extension body 42 on the inner side of the outer tube extension body 42*a*. The second dispensing tubular portion 51*b* is disposed on a front end of the first dispensing tubular portion 51*a* in an overlapped manner with the central axes thereof aligned with each other, and thus, the dispensing tube 51 is formed in a cylindrical shape having the central axis aligned with the dispensing hole 44.

Figure 4B:
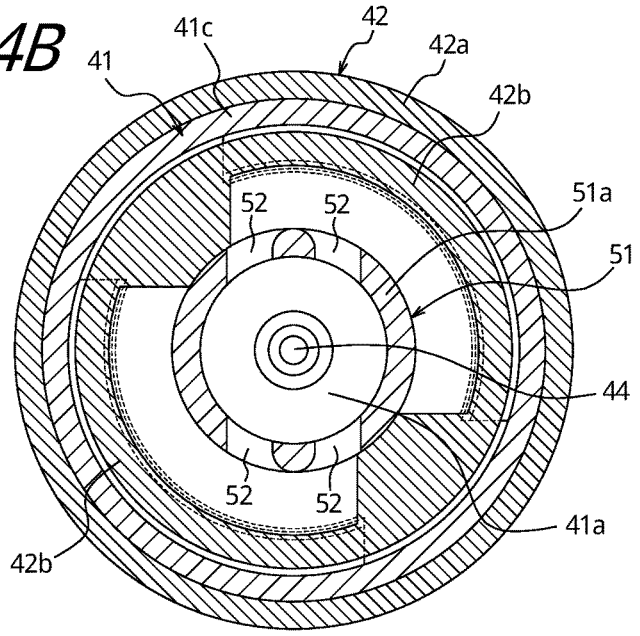
FIG. 4B is a sectional view taken along a line A-A illustrated in FIG. 4A.

Furthermore, as illustrated in FIG. 4B, the dispensing tube 51 is provided with four air inlet holes 52. These air inlet holes 52 are each a through hole that, in a section thereof, is substantially a rectangular shape extending through the dispensing tube 51 in the radial direction, and the air inlet holes 52 are disposed on the base side of the dispensing tube 51 that serves as a portion of the dispensing tube 51 that is joined to the partition wall 41*a* to be open on the inner circumferential surface side of the dispensing tube 51 in adjacent to the dispensing hole 44. The four air inlet holes 52 consist of two pairs of two air inlet holes 52 arranged side by side in the circumferential direction, and the two pairs of air inlet holes 52 are arranged to be offset by 180 degrees in the circumferential direction.

Figure 5:
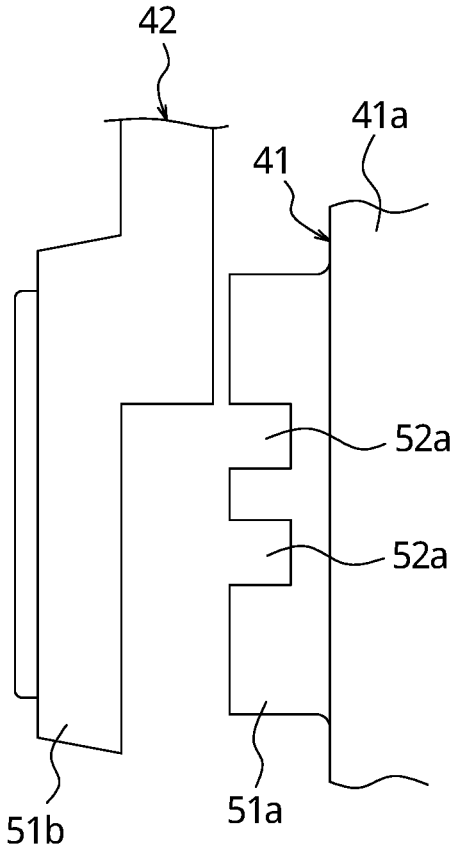
FIG. 5 is an exploded view of a half of a tubular portion and a tubular extension body that constitute a dispensing tube.

As illustrated in FIG. 5, the first dispensing tubular portion 51*a* is provided, in a front end thereof, with cut-outs 52*a* that are rectangularly concave. Opening ends of the cut-outs 52*a* are closed by an end surface of the second dispensing tubular portion 51*b* that overlaps with the front end of the first dispensing tubular portion 51*a*, and thus, the air inlet holes 52 are provided in the dispensing tube 51. That is to say, the dispensing tube 51 has a combined structure of the first dispensing tubular portion 51*a* and the second dispensing tubular portion 51*b*, and the cut-outs 52*a* provided on the surface on which these are combined form the air inlet holes 52. The above structure allows formation of the dispensing tube 51 provided with the air inlet holes 52 by combining the nozzle main body 41 and the nozzle extension body 42 that may be molded with use of simple-structure molds, without forming a nozzle provided with air inlet holes with use of complex-structure molds including, for example, a slide pin that is displaceable in a direction perpendicular to a direction in which the molds are assembled. Accordingly, simple-structure molds may be used as molds required for molding the nozzle 40, and manufacturing cost of the trigger-type liquid dispenser 1 is reduced.

According to the structure providing the air inlet holes 52 in the dispensing tube 51, once the trigger 34 is operated in the opened position of the nozzle 40, the liquid is dispensed in the form of spray from the dispensing hole 44 of the nozzle 40, and, due to the liquid dispensed in the form of spray from the dispensing hole 44, the inside of the dispensing tube 51 is placed under negative pressure, which draws air to the inside of the dispensing tube 51 from a gap portion formed between the dispensing tube 51 and the locking claws 42*b* through the air inlet holes 52. Then, the air drawn to the inside of the dispensing tube 51 through the air inlet holes 52 is mixed to the liquid dispensed in the form of spray from the dispensing hole 44, and the liquid, after being mixed with the air, is dispensed in the form of foam to the outside. Since the nozzle 40 has the double-block structure, by varying the shape of the nozzle extension body 42 to be fitted to the nozzle main body 41, the air inlet holes 52, a passage used to draw air to the outer circumference of the dispensing tube 51, or the like may be imparted with a variety of shapes permitting the quality of foam of the liquid dispensed through the nozzle 40 to be changed easily.

Additionally, the liquid may also be dispensed in the form of foam from the dispensing hole 44 of the nozzle 40 with use of a structure in which the dispensing tube 51 including the air inlet holes 52 is omitted by detaching the nozzle extension body 42 from the nozzle main body 41. In detail, using the nozzle main body 41 alone as a spray nozzle allows the liquid to be dispensed in the form of spray through the nozzle 40, and fitting the nozzle extension body 42, as a form nozzle, to the nozzle main body 41 allows the liquid to be dispensed in the form of foam through the nozzle 40.

The number of the air inlet holes 52 provided in the dispensing tube 51 is not limited to four and may be any number. Furthermore, the shape of the air inlet holes (the cut-outs 52*a*) is not limited to the aforementioned rectangular shape and may be any of a variety of shapes.

Figure 6:
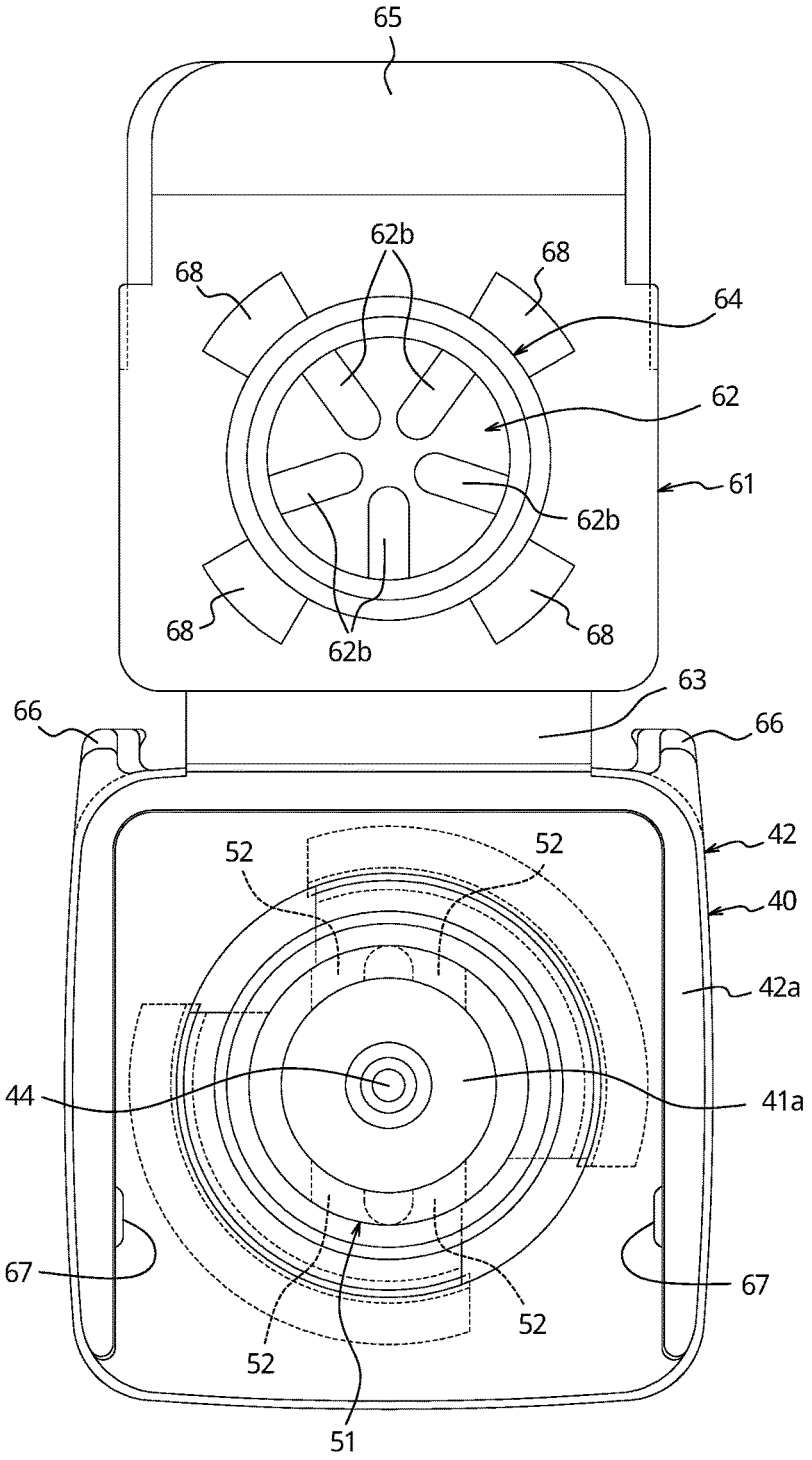
FIG. 6 is a front view of a nozzle illustrated in FIG. 2.

The nozzle is provided with a nozzle cover 61 as a cap body. As illustrated in FIG. 6, the nozzle cover 61 is formed in a substantially square plate shape corresponding to the shape of the front end of the outer tube extension body 42*a* of the nozzle extension body 42, and the nozzle cover 61 is provided in the middle thereof with a foam generation hole 62. In the illustrated example, the foam generation hole 62 is formed by five columnar bodies 62*b*, each having a rounded tip, that protrude to the inner side in the radial direction from an inner circumferential surface of the through hole 62*a*, which has a shape corresponding to the dispensing tube 51, and that are arranged side by side at an equal interval in the circumferential direction. However, the foam generation hole 62 may have any other shape, such as a mesh shape, which includes obstacle portions permitting the liquid to foam by colliding with the liquid dispensed form the dispensing hole 44.

The nozzle cover 61 is provided integrally on one side in the front end of the outer tube extension body 42*a* of the nozzle extension body 42 via a thin hinge portion 63 by injection molding of a resin material with use of a mold. The nozzle cover 61, which is thus provided integrally in the nozzle extension body 42 via the hinge portion 63, is rotatable about the hinge portion 63 between a closed position where the nozzle cover 61 closes the front end of the outer tube extension body 42*a*, in other words, covers the front end of the nozzle 40, and where the foam generation hole 62 faces the dispensing hole 44 and an opened position where the nozzle cover 61 is located along an upper surface of the nozzle 40. The nozzle cover 61 is provided integrally with a boss portion 64 surrounding the foam generation hole 62. When the nozzle cover 61 is in the closed position, the boss portion 64 engages with the outside of the dispensing tube 51 to guide the liquid dispensed from the dispensing hole 44 to the foam generation hole 62. The nozzle cover 61 is further provided, on one side thereof that is located on an opposite side to the hinge portion 63, integrally with a pickup portion 65 that is held for opening and closing operations of the nozzle cover 61.

The outer tubular body 41*c* of the nozzle main body 41 is provided, on the upper surface thereof, with a pair of holding claws 66 located on both ends on the rear end side of the upper surface. These holding claws 66 has a gap corresponding to the width of the nozzle cover 61, and when the nozzle cover 61 is in the opened position, the holder claws 66 come into undercut engagement with side portions of the nozzle cover 61, thereby holding the nozzle cover 61 in the opened position. On the other hand, the outer tube extension body 42*a* of the nozzle extension body 42 is provided, on an inner side surface of an opening end thereof, with holding claws 67 disposed on the open sides. When the nozzle cover 61 is in closed position, the holding claws 67 come into undercut engagement with side portions of the nozzle cover 61 to hold the nozzle cover 61 in the closed position.

The nozzle cover 61 of the nozzle 40 is provided with four arc-shaped vent holes 68 arranged side by side at an equal interval in the circumferential direction along an outer circumference of the boss portion 64. The vent holes 68 provide a circulation section that is sufficient to allow communication with the outside to the inner side space of the outer tube extension body 42*a* that is located between the partition wall 41*a* and the nozzle cover 61, that is to say, the space in which the dispensing tube 51 is disposed, even when the nozzle cover 61 is in the closed position to close the front end of the nozzle 40. Accordingly, even when the liquid is dispensed from the dispensing hole 44 in the closed state of the nozzle cover 61, sufficient air is supplied to the surroundings of the dispensing tube 51 through the vent holes 68, thereby allowing the liquid to be mixed with sufficient air through the air inlet holes 52.

The number and the shape of the vent holes 68 provided in the nozzle cover 61 are not limited to the aforementioned examples and may be any shape and number as long as a predetermined amount of air may be drawn to the surroundings of the dispensing tube 51 while the nozzle cover 61 is closed.

Figure 7:
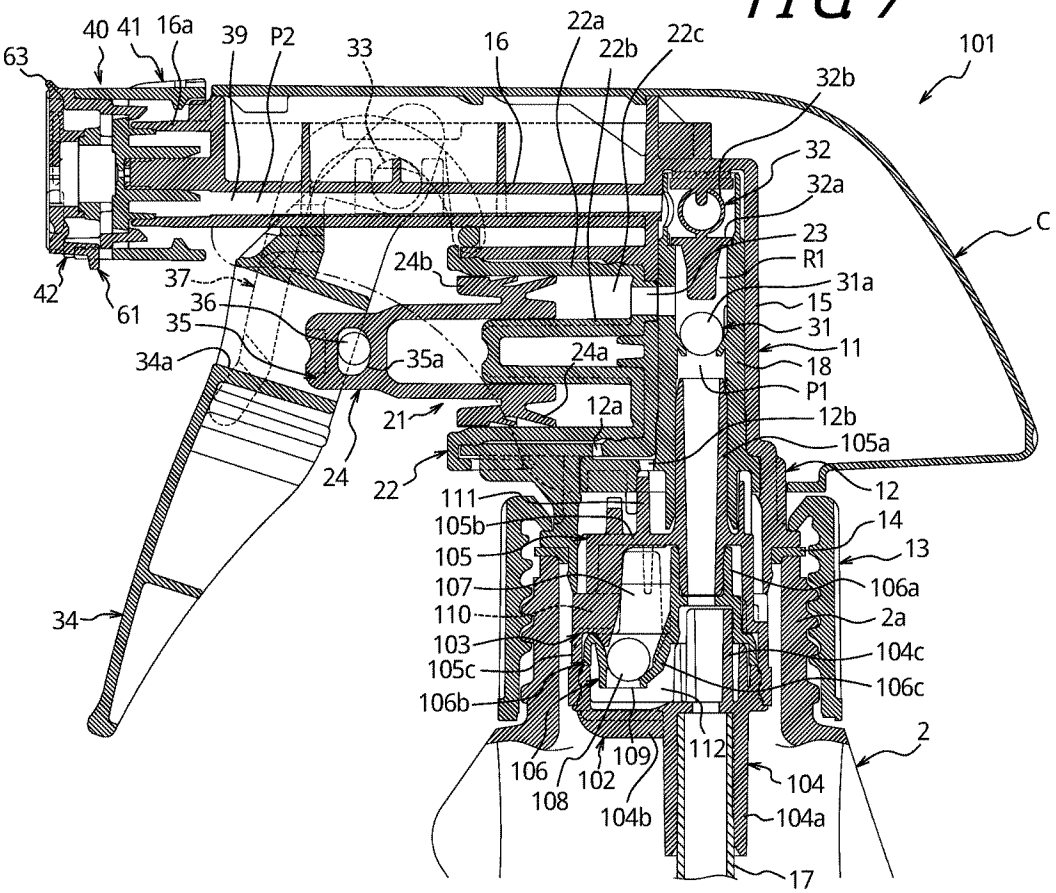
FIG. 7 is a sectional view of a trigger-type liquid dispenser according to the second embodiment of the present disclosure.
Figure 8:
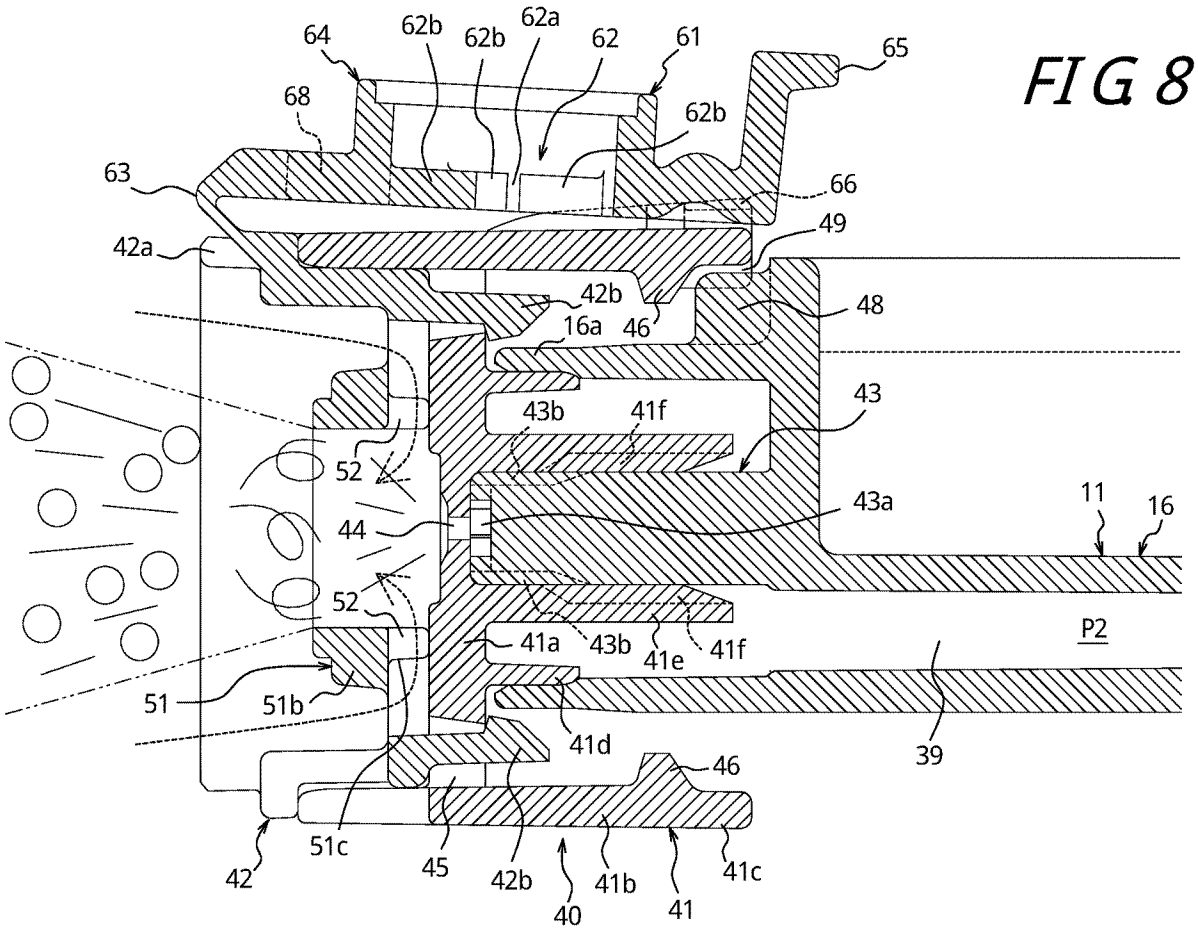
FIG. 8 is an enlarged sectional view of a portion of a trigger-type liquid dispenser illustrated in FIG. 7 to which a nozzle is fitted.
Figure 9B:
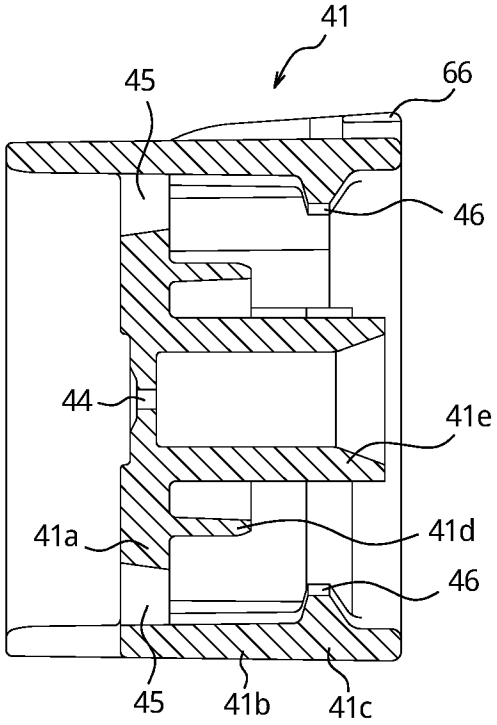
FIG. 9B is a sectional view taken along a line A-A in FIG. 9A.
Figure 9A:
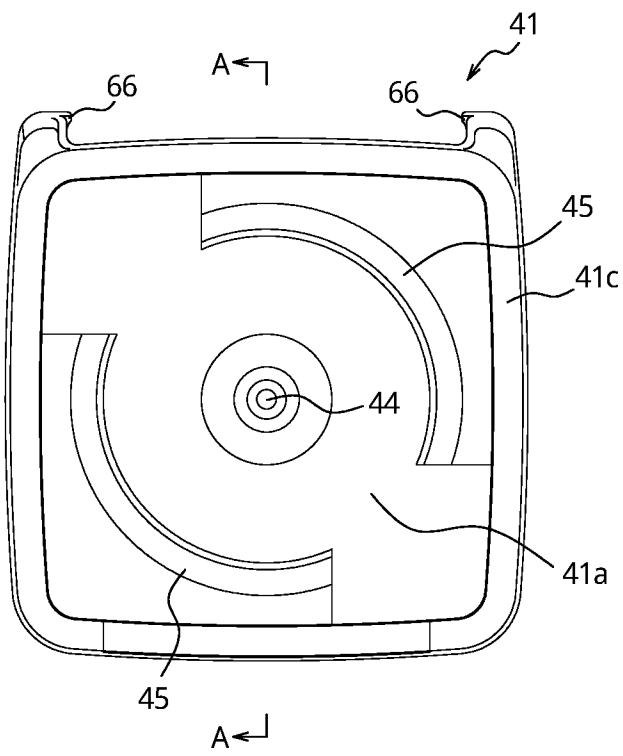
FIG. 9A is a front view of a nozzle main body illustrated in FIG. 8.
Figure 10A:
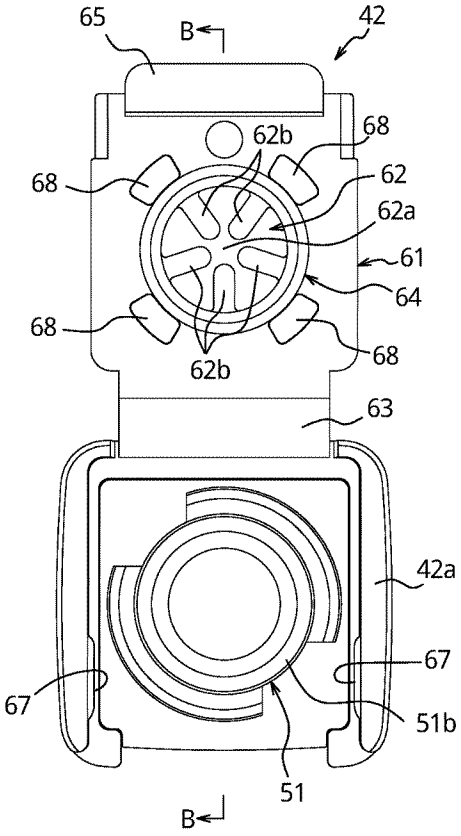
FIG. 10A is a front view of a nozzle extension body illustrated in FIG. 8.
Figure 10B:
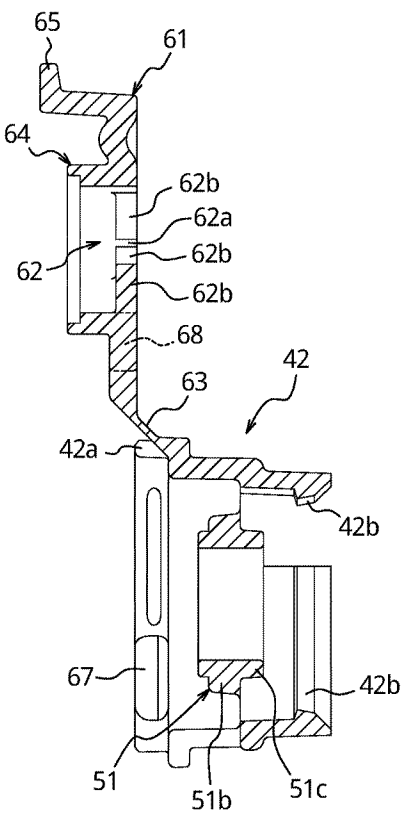
FIG. 10B is a sectional view taken along a line B-B in FIG. 10A.
Figure 10C:
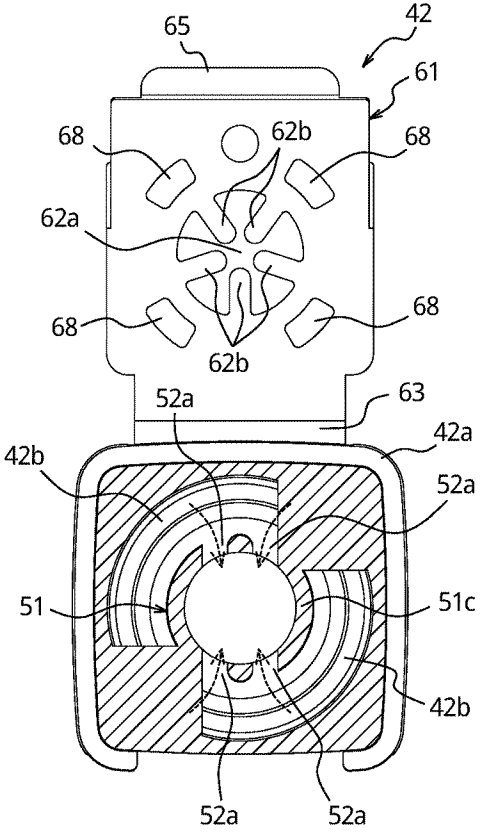
FIG. 10C is a back view of a nozzle extension body illustrated in FIG. 10A.
Figure 11:
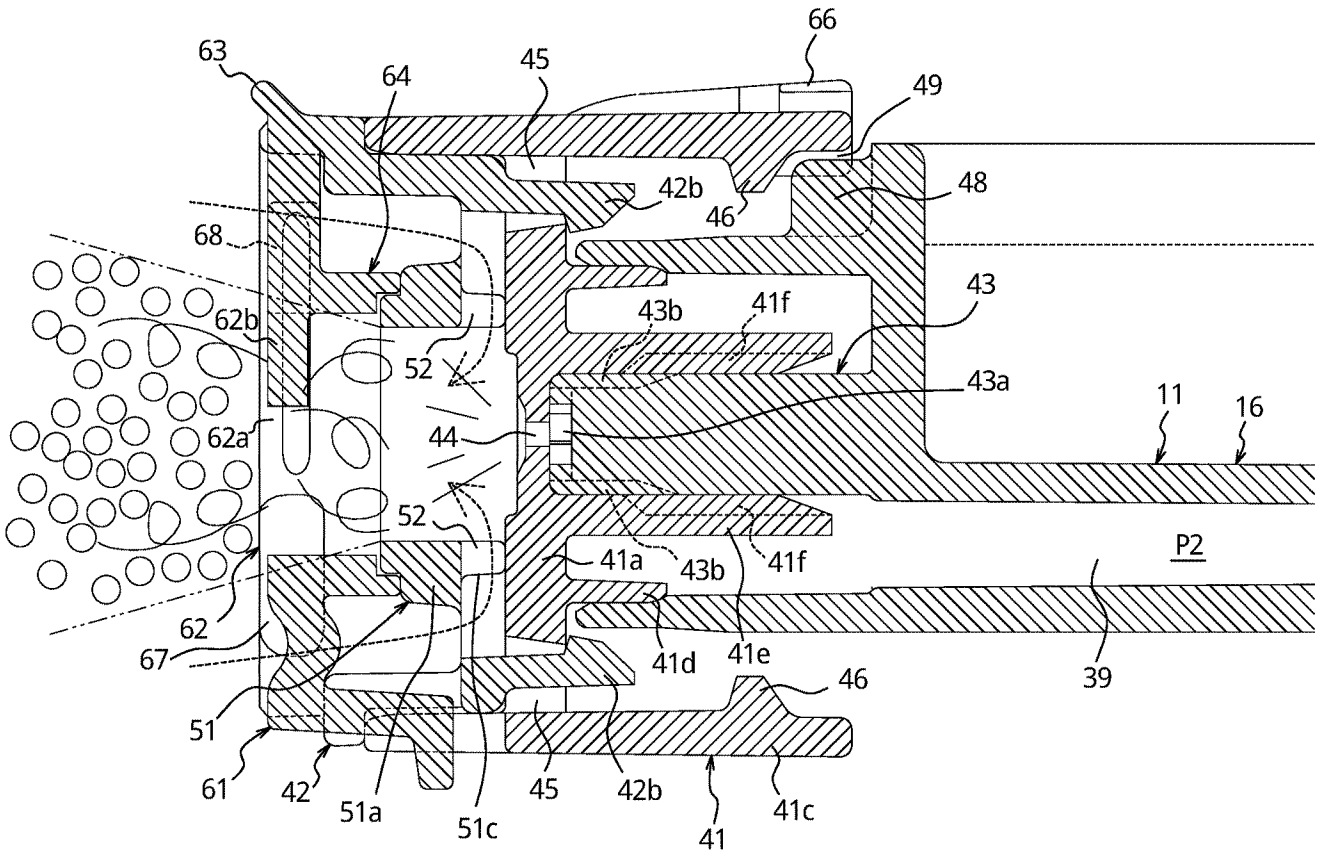
FIG. 11 is a sectional view illustrating a state where a liquid is dispensed through a nozzle while a nozzle cover is closed.

FIG. 7 is a sectional view of a trigger-type liquid dispenser according to the second embodiment of the present disclosure, and FIG. 8 is an enlarged sectional view of a portion of a trigger-type liquid dispenser illustrated in FIG. 7 to which a nozzle is fitted. FIG. 9A is a front view of a nozzle main body illustrated in FIG. 8, and FIG. 9B is a sectional view taken along a line A-A in FIG. 9A. FIG. 10A is a front view of a nozzle extension body illustrated in FIG. 8, FIG. 10B is a sectional view taken along a line B-B in FIG. 10A, and FIG. 10C is a back view of a nozzle extension body illustrated in FIG. 10A. FIG. 11 is a sectional view illustrating a state where a liquid is dispensed through a nozzle while a nozzle cover is closed.

Next, a description is given of a structure of the trigger-type liquid dispenser 101 according to the second embodiment of the present disclosure based on FIGS. 7 to 11. In FIGS. 7 to 11, members corresponding to those described above are denoted by the same reference numerals.

The trigger-type liquid dispenser 101 according to the second embodiment illustrated in FIG. 7 is an upright and inverted dual type that is capable of dispensing a liquid contained in the container 2 to the outside regardless of whether the container 2, with the trigger-type liquid dispenser 101 being fitted, is in an upright or an inverted position. Accordingly, the dispenser main body 11 is provided with an upright and inverted dual mechanism 102. The upright and inverted dual mechanism 102 includes a check valve unit 103 disposed on the inner side of the fitted tubular portion 12 and a tube attachment member 104 disposed below the check valve unit 103.

The check valve unit 103 includes an outer tubular body 105 that includes an outgoing tubular portion 105*a* connected to a lower end of the tubular body 18, that is to say, to the intake flow path P1, a top plate portion 105*b* disposed on an outer circumferential surface of the outgoing tubular portion 105*a* to extend to the outer side in the radial direction, and a circumferential wall portion 105*c* extending almost perpendicularly down from an outer circumferential edge portion of the top plate portion 105*b*. The check valve unit 103 also includes an inner tubular body 106 fitted inside the outer tubular body 105, and the inner tubular body 106 includes an inner fitted tubular portion 106*a* press-fitted and fixed to the outer side of a lower end of the outgoing tubular portion 105*a*, an outer fitted tubular portion 106*b* press-fitted and fixed to an inner circumferential surface of the circumferential wall portion 105*c* of the outer tubular body 105 over the entire circumference, and a coupling tubular portion 106*c* coupling the inner fitted tubular portion 106*a* and the outer fitted tubular portion 106*b*. Between the outer tubular body 105 and the inner tubular body 106, a valve chamber 107 is defined and formed, and a valve body 108 formed in a ball (spherical) shape is contained in the valve chamber 107. The valve chamber 107 is formed in a shape that leans to the left side in FIG. 7 with respect to the axes of the outgoing tubular portion 105*a* and the inner fitted tubular portion 106*a* and that extends vertically. The valve body 108 is displaceable in the valve chamber 107 in upward and downward directions between a lower limit position in which the valve body 108 abuts against a lower end portion of the coupling tubular portion 106*c* and an upper limit position in which the valve body 108 abuts against the top plate portion 105*b*.

The lower end portion of the coupling tubular portion 106*c* is provided with an outlet hole 109 permitting the valve chamber 107 to open to the downward direction, and the outlet hole 109 has an opening edge portion serving as a valve seat. The outlet hole 109 has an inner diameter that is smaller than the outer diameter of the ball-shaped valve body 108, and when the container 2 is in the upright position, the valve 108 abuts against the valve seat by its own weight to close the outlet hole 109, and when the container 2 is in the inverted position, the valve body 108 is displaced closer to the top plate portion 105*b* to open the outlet hole 109.

The circumferential wall portion 105*c* of the outer tubular body 105 is provided with an inlet hole 110 extending through the circumferential wall portion 105*c* in the thickness direction. The inlet hole 110 has one end that is open to the inside of the container 2 and another end that is open to a middle position of the valve chamber 107 in the vertical direction. The inlet hole 110 allows the liquid contained in the container 2 to flow into the valve chamber 107 when the container 2 is placed to the inverted position.

The top plate portion 105*b* is provided, on an upper surface thereof, with a tubular body portion 111 fitted to a lower side portion of the tubular body 18, and the vent holes 12*b* and 12*c* communicate with the inside of the tubular body portion 111 and also communicate with the inside of the container 2 via a gap between an upper end of the tubular body portion 111 and the lower side portion of the tubular body 18 and a gap between the tubular body portion 111 and an inner circumferential surface of the fitted tubular portion 12. Additionally, although not illustrated in FIG. 7, in the second embodiment, the air intake hole, which permits ambient air to be supplied into the container 2 through the vent holes 12*b* and 12*c*, is provided on a side portion of the cylinder tubular portion 22*a*.

The tube attachment member 104 includes a tube attachment cylinder 104*a* to which the tube 17 is fitted and fixed. The tube attachment member 104 also includes a cap body portion 104*b* that is disposed on an outer circumferential surface of the tube attachment cylinder 104*a* to extend to the outer side in the radial direction and that has an outer circumferential edge in undercut engagement with the inner circumferential surface of the circumferential wall portion 105*c* of the check valve unit 103 over the entire circumference, and thus, the tube attachment member 104 is fixed to the check valve unit 103. Between the cap body portion 104*b* of the tube attachment member 104 and the inner tubular portion 106 of the check valve unit 103, an inversion-time flow path 112 is defined and formed. The inversion-time flow path 112 communicates with a connecting tubular body portion 104*c* that is disposed on an inner surface of the cap body portion 104*b* coaxially with the tube attachment cylinder 104*a* and that, in a section thereof, has a C-shape. Via the connecting tubular body portion 104*c*, the inversion-time flow path 112 is connected to the outgoing tubular portion 105*a* of the check valve unit 103, that is to say, to the intake flow path P1.

In the trigger-type liquid dispenser 101 including the upright and inverted dual mechanism 102 with the above structure, once the trigger 34 is operated in the upright position of the container 2, in which the mouth 2*a* of the container 2 faces upward, the liquid contained in the container 2 passes through the tube 17, the connecting tubular body portion 104*c*, and the outgoing tubular portion 105*a*, reaches the intake flow path P1, and is drawn into the pump 21. At this time, since the outlet hole 109 of the check valve unit 103 is closed by the valve body 108, air that is present in the container 2 is prevented from being drawn to the pump 21 through the intake flow path P1, the inversion-time flow path 112, the outlet hole 109, the valve chamber 107, and the inlet hole 110. This ensures that the liquid may be drawn to the pump 21 through the path passing the tube 17.

On the other hand, once the trigger 34 is operated in the inverted position of the container 2, in which the mouth 2*a* of the container 2 faces downward, the liquid contained in the container 2 is accumulated inside the fitted tubular portion 12, and the accumulated liquid flows into the valve chamber 107 through the inlet hole 110 of the check valve unit 103. At this time, since the valve body 108 is displaced, due to its own weight, to the upper limit position in which the valve body 108 abuts against the top plate portion 105*b* to open the outlet hole 109, the liquid, after flowing into the valve chamber 107, flows to the inversion-time flow path 112 through the outlet hole 109, and then, is drawn to the pump 21 via the connecting tubular body portion 104*c*, the outgoing tubular portion 105*a*, and the intake flow path P1.

In this way, the trigger-type liquid dispenser 101 of the upright and inverted dual type including the upright and inverted dual mechanism 102 according to the second embodiment is capable of dispensing the liquid contained in the container 2 to the outside regardless of whether the container 2, with the trigger-type liquid dispenser 101 being fitted, is in the upright or the inverted position.

Additionally, according to the trigger-type liquid dispenser 101 of the second embodiment, the delivery hole 23 is connected to the partition chamber 22*c* in the pump 21, and the delivery hole 23 also plays the role of the intake hole 26. Accordingly, the intake-side check valve 31 is of a ball valve type, and the valve main body 31*a* is formed in a ball (spherical) shape and disposed inside the intake flow path P1 to abut against the valve seat provided in the intake flow path P1 from above.

Furthermore, in the trigger-type liquid dispenser 101 according to the second embodiment, the sealing portion 24*a* of the piston 24 is shaped to include a pair of tapered tubular-shaped sealing pieces inclined to the same direction, and, on the outer side of the sealing portion 24*a*, there is integrally provided a cylindrical-shaped guide piece 24*b* that slides against the inner circumferential surface of the cylinder tubular portion 22*a* and that, in the section thereof, has a rectangular shape. With the structure including the cylindrical-shaped guide piece 24*b* that slides against the inner circumferential surface of the cylinder tubular portion 22*a*, even when transverse force, such as external force, is applied to the trigger 34, transverse load, applied from the trigger 34 to the piston 24, is received by the cylinder tubular portion 22*a* via the cylindrical-shaped guide piece 24*b*, and accordingly, deformation of the sealing portion 24*a* due to the transverse force is prevented. This prevents the liquid from leaking from between the cylinder member 22 and the piston 24 when transverse force is applied to the trigger 34.

As illustrated in FIG. 8, in the trigger-type liquid dispenser 101 according to the second embodiment, the dispensing tube 51 does not have the combined structure of the first dispensing tubular portion 51*a* and the second dispensing tubular portion 51*b* which are disposed separately on the side of the nozzle main body 41 and on the side of the nozzle extension body 42, and the dispensing tube 51 is provided integrally with the nozzle extension body 42.

That is to say, as illustrated in FIGS. 9A and 9B, the first dispensing tubular portion 51*a* is not provided on a surface of the partition wall 41*a* of the nozzle main body 41 that faces to the outside (the side of the second dispensing tubular portion 51*b*), and this outside surface of the partition wall 41*a* is formed in a substantially flat shape having a slightly concave portion that is coaxial with the dispensing hole 44.

On the other hand, as illustrated in FIGS. 10A to 10C, on the inner side of the outer tube extension body 42*a* of the nozzle extension body 42, the cylindrical-shaped dispensing tube 51 is provided integrally with the outer tube extension body 42*a*. The dispensing tube 51 includes the second dispensing tubular portion 51*b*, which has substantially the same shape as in the first embodiment, and a cylindrical-shaped rib 51*c* provided coaxially and integrally with a base end surface (a surface facing to the partition wall 41*a*) of the second dispensing tubular portion 51*b*. Furthermore, on a base end surface of the dispensing tube 51 that faces to the partition wall 41*a*, that is to say, a base end surface of the cylindrical-shaped rib 51*c* that faces to the partition wall 41*a*, cut-outs 52*a* are provided. In the present embodiment, as illustrated in FIG. 10C, four cut-outs 52*a* are provided in the cylindrical-shaped rib 51*c*.

As illustrated in FIG. 8, when the nozzle extension body 42 is attached to the nozzle main body 41, the base end surface of the dispensing tube 51, in detail, the cylindrical-shaped rib 51*c*, comes into abutment with the outside surface of the partition wall 41*a*, and opening ends of the cut-outs 52*a* are closed by the outside surface of the partition wall 41*a*, and thus, four air inlet holes 52 are defined in the dispensing tube 51.

In this way, the structure according to the second embodiment also allows formation of the dispensing tube 51 provided with the air inlet holes 52 by combining the nozzle main body 41 and the nozzle extension body 42 that may be molded with use of simple-structure molds, without forming a nozzle provided with air inlet holes with use of complex-structure molds including, for example, a slide pin that is displaceable in a direction perpendicular to a direction in which the molds are assembled. Accordingly, simple-structure molds may be used as molds required for molding the nozzle 40, and manufacturing cost of the trigger-type liquid dispenser 101 is reduced.

Furthermore, since the nozzle 40 provided with the air inlet holes 52 may be formed easily by using a method, such as pinch-off, without using a slide pin or the like, the positions, number, size, and so forth of the air inlet holes 52 may be determined arbitrarily. Accordingly, the air inlet holes 52 may be provided in any suitable positions in the dispensing tube 51, and this allows the liquid to be mixed with air in a well-balanced manner.

Moreover, the fact that the nozzle 40 provided with the air inlet holes may be formed easily without using complex-structure molds including, for example, a slide pin, for example, simplifies mold structure, increases the number of cavities, and improves molding cycle, and accordingly, productivity of the trigger-type liquid dispenser 101 is enhanced.

Moreover, according to the structure of the second embodiment also, since the air inlet holes 52 are provided in the dispensing tube 51, when the liquid is dispensed in the form of spray from the dispensing hole 44 of the nozzle 40, due to the dispensed liquid, the inside of the dispensing tube 41 is placed under negative pressure, which draws air to the inside of the dispensing tube 51 from the outer circumferential side of the dispensing tube 51 through the air inlet holes 52. Then, the air is mixed to the liquid dispensed in the form of spray from the dispensing hole 44, and the liquid is dispensed in the form of foam to the outside. At this time, the liquid in the form of spray, upon hitting the inner circumferential surface of the dispensing tube 51, creates turbulence, and the air is caught in the created turbulence, and thus, the air is drawn to the inside of the dispensing tube 51 from the air inlet holes 52 efficiently. Accordingly, even finer foam is generated.

On the other hand, as illustrated in FIG. 11, when the nozzle cover 61 is closed, the liquid dispensed in the form of foam from the dispensing hole 44 hits five columnar-shaped bodies 62*b* provided in the foam generation hole 62 of the nozzle cover 61, and consequently, the liquid creates stronger turbulence. This allows the air to be drawn to the inside of the dispensing tube 51 from the air inlet holes 52 even more efficiently and mixed to the liquid even more effectively, and accordingly, the liquid is dispensed in the form of even finer foam to the outside.

Additionally, as illustrated in FIG. 9B, in the second embodiment, the step portion to which the outer tube extension body 42*a* of the nozzle extension body 42 is fitted is not provided on the outer circumferential surface of the front end portion of the outer tubular body 41*c* of the nozzle main body 41, and leg portion of the locking claws 42*b* of the nozzle extension body 42 are fitted with the inner side of the outer tubular body 41*c*. Furthermore, the outer tubular body 41*c* of the nozzle main body 41 is formed in a long cylindrical shape significantly protruding toward the front end beyond the partition wall 41*a* in a manner such that the outer tubular body 41*c* covers the entire outer circumferential side of the dispensing tube 51. The above structure makes the nozzle main body 41 easy to hold by hand and facilitates rotational operation of the nozzle 40 when the nozzle main body 41 (the nozzle 40) is rotated between the closed and the opened state for switching opening and closing of the dispensing hole 44 in a state where the nozzle extension body 42 is not attached to the nozzle main body 41.

Needless to say, the present disclosure is not limited to the above embodiments, and various changes may be made without departing the gist of the present disclosure.

For example, although in the above embodiments the nozzle 40 is fitted rotatably to the fitted portion 16*a* and configured to be switchable between the opened and the closed position, such a switching mechanism may be omitted.

Furthermore, although in the above embodiments the pump 21 includes the annular ring-shaped partition chamber 22*c* and the cylindrical-shaped piston 24, the present disclosure is not limited to these embodiments. The pump 21 may have any other structure as long as the pump 21 may be actuated in response to operation of the trigger 34 to force-feed the liquid contained in the container 2 to the delivery port 39.

Moreover, in the first embodiment, the cut-outs 52*a* are provided in the front end of the first dispensing tubular portion 51*a* formed integrally with the partition wall 41*a*. However, the cut-outs 52*a* may be provided in the base end of the second dispensing tubular portion 51*b* that faces to the first dispensing tubular portion 51*a*, and opening ends of the cut-outs 52*a* may be closed by a front end surface of the first dispensing tubular portion 51*a* to form the air inlet holes 52.

Moreover, although the trigger-type liquid dispenser 1 of the first embodiment illustrated in FIG. 1 differs from the trigger-type liquid dispenser 101 of the second embodiment illustrated in FIG. 2 in terms of structure, namely, the presence of the upright and inverted dual mechanism, the nozzle 40 of the first embodiment and the nozzle 40 of the second embodiment may be applied to the dispenser main body 11 in either embodiment, and moreover, the nozzle 40 of the first embodiment and the nozzle 40 of the second embodiment may be applied to a trigger-type liquid dispenser having another structure.

REFERENCE SIGNS LIST

1 Trigger-type liquid dispenser
2 Container
2*a* Mouth
11 Dispenser main body
12 Fitted tubular portion
12*a* Flange portion
12*b*, 12*c* Vent hole
13 Fitting cap
13*a* Female screw
14 Sealing member
15 Standing portion
16 Extension portion

16*a* Fitted portion
17 Tube
18 Tubular body
18*a* Partition wall
21 Pump
22 Cylinder member
22*a* Cylinder tubular portion
22*b* Partition tubular portion
22*c* Partition chamber
23 Delivery hole
24 Piston
24*a* Sealing portion
24*b* Cylindrical-shaped guide piece
25 Intake tubular portion
25*a* Front end surface (valve seat)
26 Intake hole
31 Intake-side check valve
31*a* Valve main body
31*b* Elastic portion
32 Delivery-side check valve
32*a* Valve main body
32*b* Elastic portion
33 Pivot shaft
34 Trigger
34*a* Orifice portion
35 Coupling piece
35*a* Concave portion
36 Pin member
37 Plate spring
38 Air intake hole
39 Delivery port
40 Nozzle
41 Nozzle main body (spray nozzle)
41*a* Partition wall
41*b* Outer circumferential wall
41*c* Outer tubular body
41*d* Closing tubular portion
41*e* Switch tubular portion
41*f* Connecting flow path
42 Nozzle extension body (foam nozzle)
42*a* Outer tube extension body
42*b* Locking claw
43 Switch shaft portion
43*a* Concave portion
43*b* Connecting flow path
44 Dispensing hole
45 Through hole
46 Locking protrusion
47 Protruding portion
48 Protrusion
49 Protrusion
51 Dispensing tube
51*a* First dispensing tubular portion
51*b* Second dispensing tubular portion
51*c* Cylindrical-shaped rib
52 Air inlet hole
52*a* Cut-out
61 Nozzle cover (cap body)
62 Foam generation hole
62*a* Through hole
62*b* Columnar-shaped body
63 Hinge portion
64 Boss portion
65 Pickup portion
66 Holding claw
67 Holding claw
68 Vent hole
101 Trigger-type liquid dispenser
102 Upright and inverted dual mechanism
103 Check valve unit
104 Tube attachment member
104*a* Tube attachment cylinder
104*b* Cap body portion
104*c* Connecting tubular body portion
105 Outer tubular body
105*a* Outgoing tubular portion
105*b* Top plate portion
105*c* Circumferential wall portion
106 Inner tubular body
106*a* Inner fitted tubular portion
106*b* Outer fitted tubular portion
106*c* Coupling tubular portion
107 Valve chamber
108 Valve body
109 Outlet hole
110 Inlet hole
111 Tubular body portion
112 Inversion-time flow path
P1 Intake flow path
P2 Delivery flow path
R1 Check valve chamber
S Stopper
C Cover

The invention claimed is:

1. A trigger-type liquid dispenser comprising: a dispenser main body fitted to a mouth of a container containing a liquid; a pump configured to be actuated, in response to operation of a trigger, to force-feed the liquid contained in the container to a delivery port through a delivery flow path provided in the dispenser main body; and a nozzle fitted to the dispenser main body to dispense, to outside, the liquid force-fed to the delivery port, wherein the dispenser main body includes a cylindrical-shaped fitted portion communicating with the delivery port, the nozzle includes: a nozzle main body in which a tubular-shaped outer tubular body, which covers an outer circumference of the fitted portion, and a partition wall, which is disposed on an inner side of the outer tubular portion to cover an opening end of the fitted portion and which is provided with a dispensing hole, are integrally provided; and a nozzle extension body that includes a tubular-shaped outer tube extension body coupled to a front end of the outer tubular body and that is fitted to the nozzle main body from a direction extending along a central axis of the nozzle main body, the outer tube extension body being provided, on a front end thereof and via a hinge portion, integrally with a cap body including a foam generation hole facing to the dispensing tube, and the cap body being provided with a vent hole that, when the front end of the outer tube extension body is closed by the cap body, draws air to inner side space of the outer tube extension body that is located between the partition wall and the cap body, the nozzle is provided with a dispensing tube including: a first dispensing tubular portion that is formed in a cylindrical shape having a central axis aligned with a central axis of the dispensing hole and that is provided integrally on a surface of the partition wall that faces to the outside; and a cylindrical-shaped second dispensing tubular portion that is provided integrally with the outer tube extension body on an inner side of the outer tube extension body and that is disposed on a front end of the first dispensing tubular portion in an overlapped manner, and a cut-out is provided in the front end of the first dispensing tubular portion or in a base end of the second dispensing tubular portion, and an opening end of the cut-out is closed by the first or the second dispensing tubular portion to provide an air inlet hole in the dispensing tube.

2. A trigger-type liquid dispenser comprising: a dispenser main body fitted to a mouth of a container containing a liquid; a pump configured to be actuated, in response to operation of a trigger, to force-feed the liquid contained in the container to a delivery port through a delivery flow path provided in the dispenser main body; and a nozzle fitted to the dispenser main body to dispense, to outside, the liquid force-fed to the delivery port, wherein the dispenser main body includes a cylindrical-shaped fitted portion communicating with the delivery port, the nozzle includes: a nozzle main body in which a tubular-shaped outer tubular body, which covers an outer circumference of the fitted portion, and a partition wall, which is disposed on an inner side of the outer tubular portion to cover an opening end of the fitted portion and which is provided with a dispensing hole, are integrally provided; and a nozzle extension body that includes a tubular-shaped outer tube extension body coupled to a front end of the outer tubular body and that is fitted to the nozzle main body from a direction extending along a central axis of the nozzle main body, the outer tube extension body being provided, on a front end thereof and via a hinge portion, integrally with a cap body including a foam generation hole facing to the dispensing tube, and the cap body being provided with a vent hole that, when the front end of the outer tube extension body is closed by the cap body, draws air to inner side space of the outer tube extension body that is located between the partition wall and the cap body, the nozzle further includes a dispensing tube that is formed in a cylindrical shape having a central axis aligned with a central axis of the dispensing hole, that is provided integrally with the outer tube extension body on an inner side of the outer tube extension body, and that has a base end abutting against a surface of the partition wall that faces to the outside, and a cut-out is provided in the base end of the dispensing tube, and an opening end of the cut-out is closed by the partition wall to provide an air inlet hole in the dispensing tube.

* * * * *